United States Patent [19]

Rathert

[11] 4,144,823

[45] Mar. 20, 1979

[54] COLLAPSIBLE TABLE AND SEAT ASSEMBLY

[76] Inventor: Larry F. Rathert, 1527 Franklin Dr., Inkster, Mich. 48141

[21] Appl. No.: 802,881

[22] Filed: Jun. 2, 1977

[51] Int. Cl.[2] ..... A47B 39/00; A47B 3/00

[52] U.S. Cl. ..... 297/159; 108/115; 297/139

[58] Field of Search ..... 108/128, 115; 297/159, 297/157, 17, 139, 142, 141; 312/235 R; 248/174

[56] References Cited

U.S. PATENT DOCUMENTS

| | | | |
|---|---|---|---|
| 1,277,988 | 9/1918 | Miller | 108/128 X |
| 1,936,969 | 11/1933 | Osterberg | 297/139 |
| 2,025,395 | 12/1935 | Lehn | 297/15 X |
| 2,260,371 | 10/1941 | Forsberg | 108/128 X |
| 2,445,489 | 7/1948 | Mangold | 108/128 X |
| 2,628,659 | 2/1953 | Carpenter | 312/235 R |
| 3,165,077 | 1/1965 | Olson | 108/128 X |
| 3,885,829 | 5/1975 | Haeger | 297/159 |
| 3,960,092 | 6/1976 | Levkovski | 108/128 |
| 3,994,527 | 11/1976 | Nikitits | 297/159 |

*Primary Examiner*—James T. McCall
*Attorney, Agent, or Firm*—Gifford, Chandler, VanOphem, Sheridan & Sprinkle

[57] ABSTRACT

A collapsible table and seat assembly is provided and comprises a housing having a hollow interior and preferably rectangular in cross-sectional shape. A foldable tabletop is contained within the housing interior which can be extended out through the top of the housing and unfolded. After unfolding the tabletop, the housing forms a base for the tabletop and supports it in an elevated and substantially horizontal orientation. In addition, a seat is formed in each sidewall of the housing which can be pivotally extended from the housing underneath the tabletop.

9 Claims, 8 Drawing Figures

Fig-1
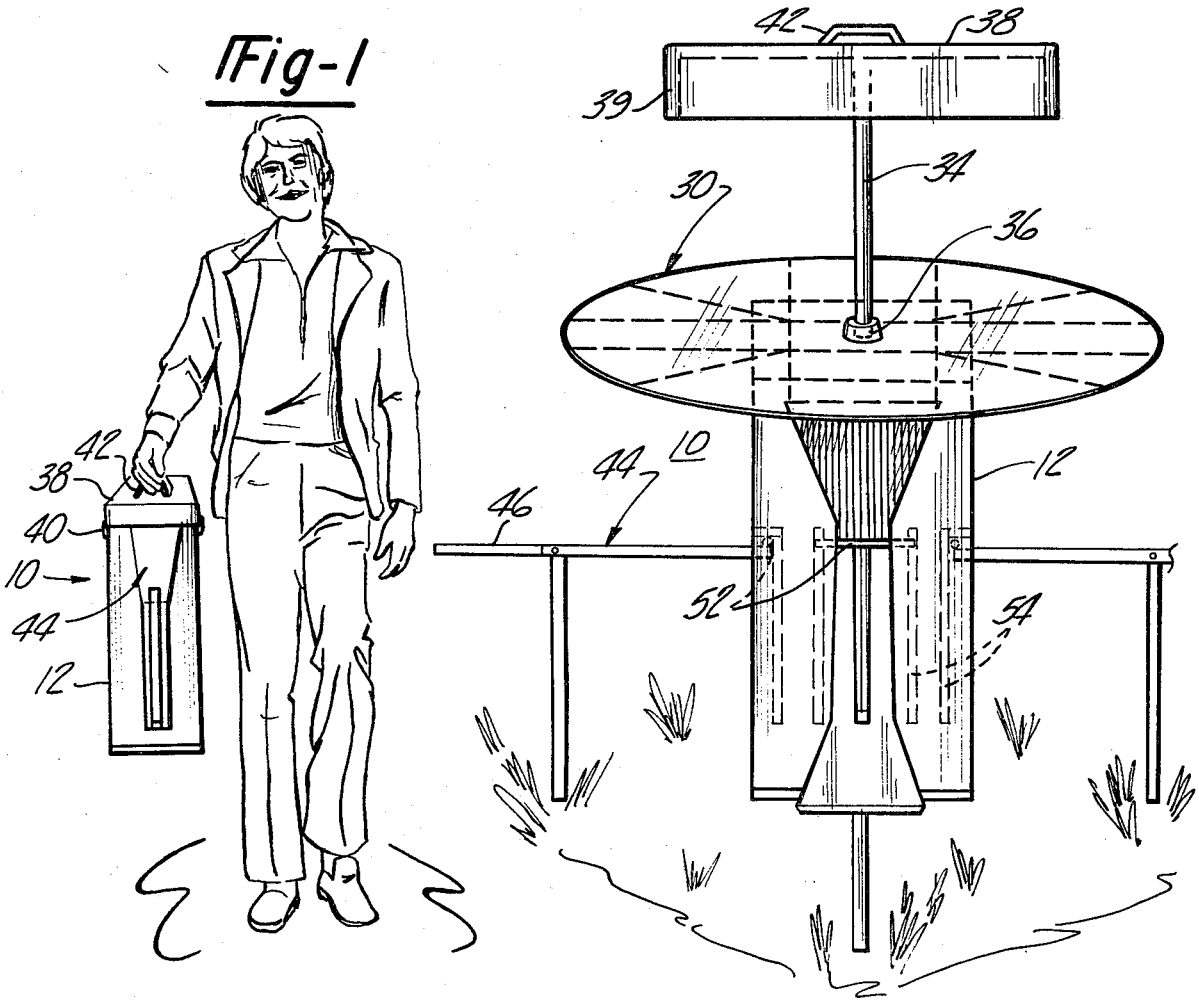
Fig-3
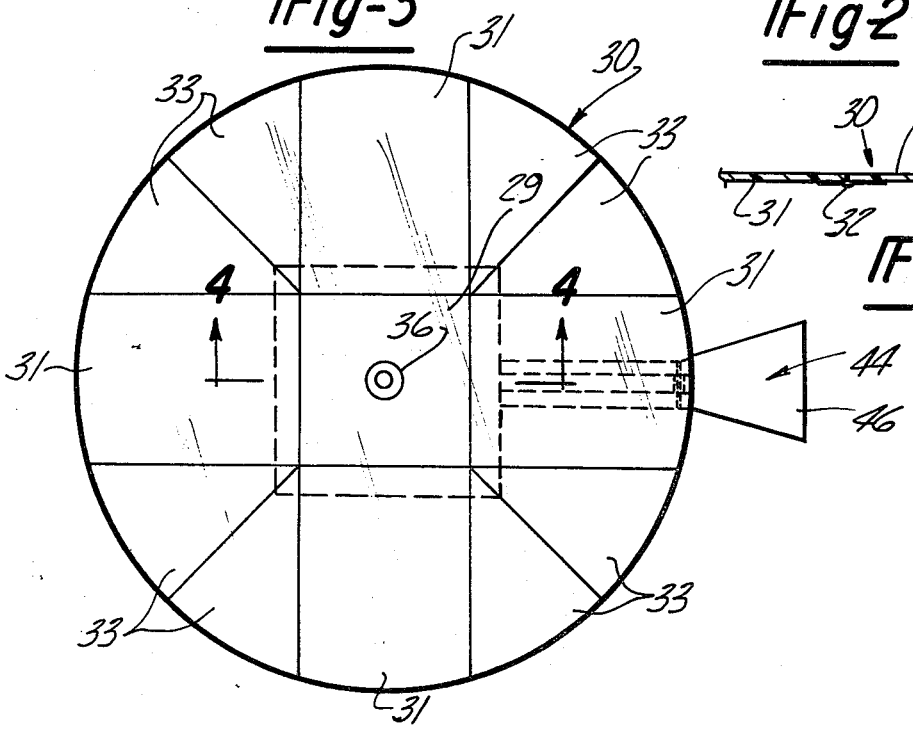
Fig-2
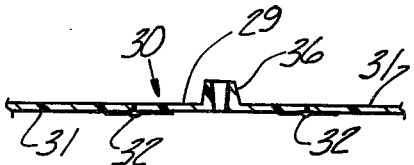
Fig-4

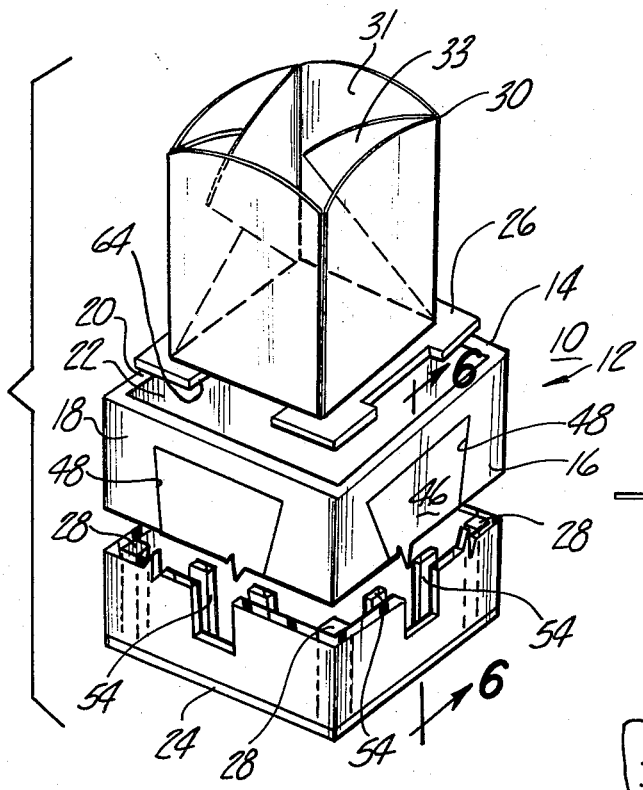
Fig-5
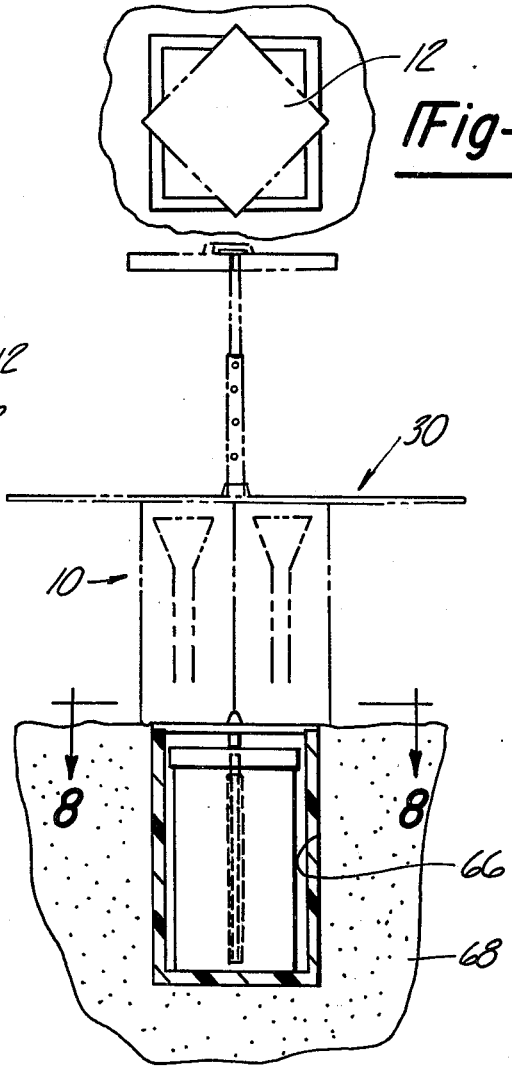
Fig-8
Fig-7
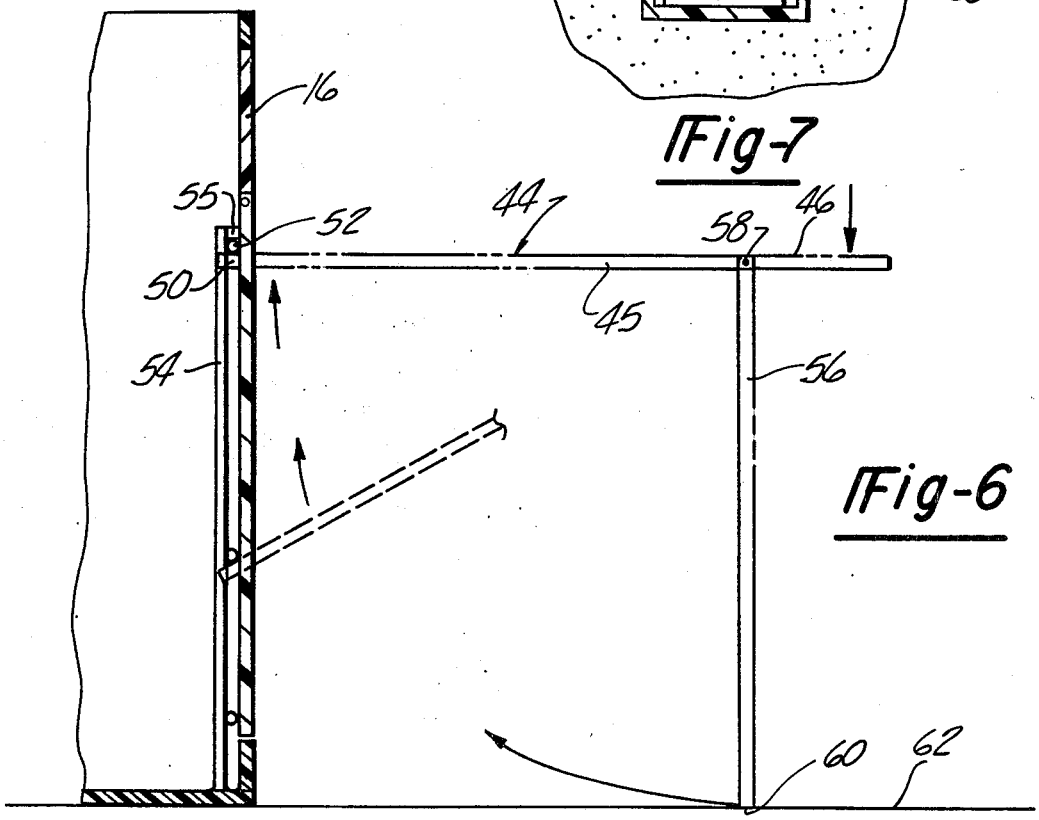
Fig-6

COLLAPSIBLE TABLE AND SEAT ASSEMBLY

BACKGROUND OF THE INVENTION

I. Field of the Invention

The present invention relates to a collapsible table and seat assembly.

II. Description of the Prior Art

There are a number of previously-known collapsible table assemblies, many of which are also combined with a collapsible seat assembly. These previously-known devices, such as described in U.S. Pat. Nos. 3,994,527 and 3,885,829, are advantageous in that, when collapsed, these devices are compact and can be easily carried and stored.

These previously-known collapsible table and seat assemblies, however, are disadvantageous in that, when collapsed, the upper table surface forms the outer casing of the collapsed device. Consequently, the tabletops of these previously-known devices are subjected to abuse, nicks, dirt, grime, and the like while being transported. Such abuse to the tabletop is particularly undesirable since embedded dirt and grime in the tabletop may present a sanitary hazard.

These previously-known collapsible table and seat assemblies are also disadvantageous due to their complex construction. As a result, these previously-known devices are difficult and awkward to both unfold and collapse and oftentimes require several persons to perform either of these operations. Moreover, these previously-known devices are expensive in construction and, as a result, have not enjoyed wide-spread acceptance or use.

SUMMARY OF THE PRESENT INVENTION

The present invention overcomes the above-mentioned disadvantages of the previously-known collapsible table and seat assemblies by providing such a device in which, when collapsed, the tabletop is protected from external abuse and which also can be simply unfolded and/or collapsed.

In brief, the collapsible table and seat assembly according to the present invention comprises a substantially rectangular housing having sidewalls and a hollow interior but open at its top. A tabletop is secured at its center to a carriage which is vertically slidably disposed within the interior of the housing. The tabletop is foldable into a cubical shape on top of the carriage so that the cross-sectional shape of the tabletop is smaller than the housing. Thus, when folded, the tabletop can be inserted into the interior of the housing in unison with the carriage. Conversely, the tabletop can be withdrawn from the interior and through the open top of the housing. Thereafter, upon unfolding the tabletop extends across and is supported in an elevated horizontal position by the housing.

In addition, a seat is formed from and pivotally secured to each sidewall of the housing. After extending the tabletop from the interior of the housing, each seat pivots horizontally outwardly from the housing, underneath and laterally outwardly from the tabletop for use as a seat to the tabletop.

As will become more readily apparent as the description proceeds, the collapsible table and seat assembly of the present invention is inexpensive in construction and yet durable in use. Moreover, since the table top extends outwardly from the top of the housing, the device of the present invention can be conveniently stored in a sunken recess for backyard or patio use.

BRIEF DESCRIPTION OF THE DRAWING

The collapsible table and seat assembly according to the present invention will be better understood upon reference to the following detailed description when read in conjunction with the accompanying drawing, wherein like reference characters refer to like parts throughout the several views, and in which:

FIG. 1 is a perspective view showing the device of the present invention being carried by a user in its collapsed condition;

FIG. 2 is a perspective view illustrating the device of the present invention in its unfolded condition;

FIG. 3 is a top plan view illustrating the device of the present invention in its unfolded condition;

FIG. 4 is a fragmentary cross-sectional view taken substantially along line 4—4 in FIG. 3;

FIG. 5 is a fragmentary exploded perspective view illustrating the device of the present invention;

FIG. 6 is a fragmentary partial cross-sectional view taken substantially along line 6—6 in FIG. 5 and enlarged for clarity;

FIG. 7 is a side plan view illustrating the device of the present invention in its unfolded condition and one means for advantageously storing the device of the present invention; and FIG. 8 is a plan view taken substantially along line 8—8 in FIG. 7.

DETAILED DESCRIPTION OF THE PRESENT INVENTION

With reference first to FIGS. 1, 2, and 5, the collapsible table and seat assembly 10 of the present invention is thereshown and comprises a housing 12 having four sidewalls 14, 16, 18, and 20. The sidewalls 14–20 are secured together along their abutting edges and define a hollow housing interior 22 which is rectangular and preferably square in cross-sectional shape. In addition, the housing 12 is closed at its bottom by means of a bottom plate 24 secured acorss the bottom edge of all of the sidewalls 14–20. The housing 12 can be constructed of any suitable material, but preferably is constructed from lightweight wood for sturdiness and yet ease of portability.

Referring now to FIGS. 2–5, a carriage 26 in the form of a substantially rectangular or square platform is vertically slidably disposed within the interior 22 of the housing 12. Preferably, a suitable stop member 28 (FIG. 5) is secured along each vertical corner of the housing 12 to abut against the bottom of the carriage 26 and limit its lowermost travel within the interior 22 of the housing 12.

With reference to FIGS. 3–5, the center portion 29 of a collapsible tabletop 30 is secured onto the upper side of the carriage 26 by any conventional means. The center portion 29 of the tabletop 30 is square in shape and smaller in cross-sectional area than the carriage 26. A substantially rectangular outer tabletop section 31 is pivotally secured by a hinge 32 (FIG. 4) to each edge of the center section 29 while a pair of pie-shaped tabletop sections 33 are pivotally secured by hinges (not shown) between each adjacent pair of rectangular sections 31. The outer edge of the tabletop sections 31 and 33 is arcuate so that, when unfolded, the tabletop 30 is round.

The outer tabletop sections 31 and 33 can be folded to the cubical configuration shown in FIG. 5 in which the outer tabletop sections 31 and 33 are folded upwardly from the central tabletop section 29. Thus, with the tabletop 33 folded as shown in FIG. 5, it can be moved downwardly into the interior 22 of the housing 12 in unison with the carriage 26. The stop members 28 are vertically positioned within the housing 12 so that, upon abutment with the carriage 26, the tabletop 30 is contained entirely within the interior 22 of the housing 12.

Conversely, as shown in FIGS. 2 and 3, the tabletop 30 can be withdrawn from the housing 12 through its top and unfolded so that the tabletop sections 29, 31, and 33 lie in the same and typically horizontal plane. In addition, when unfolded, the outer sections 31 and 33 of the tabletop 30 extend laterally outwardly over the upper edges of the housing sidewalls 14–20 so that the housing 12 supports the tabletop 30 in an elevated and substantially horizontal plane. Appropriate locking means, of course, can be provided between the adjacent tabletop sections 29, 31, and 33 to lock the tabletop 30 in its unfolded position and thereby prevent the unintended collapse of the tabletop 30.

With reference to FIGS. 2–4 in order to extend or retract the tabletop 30 from or into the housing 12, an elongated vertical rod 34 is secured at its lower end to a connector 36 centrally secured to the tabletop central section 29 and, at its upper end, to a cover 38. The cover 38 includes an outer lip 39 which fits over the upper end of the sidewalls 14–20 when the cover 38 is in its lowermost position and, when raised as shown in FIG. 2, the cover 38 forms a small umbrella for the device 10. By this arrangement, the tabletop 30 can be extended from the interior 22 of the housing 12 by simply moving the cover 38 with the attached rod 34 upwardly from the housing 12. Conversely, to insert the tabletop 30 into the interior 22 of the housing 12, the tabletop 30 is first folded to its cubical form and then moved into the interior of the housing 12 by pushing the cover 38 onto the top of the housing 12. With the cover 38 in its lowermost position, appropriate latches 40 (FIG. 1) are preferably provided to secure the cover 38 to the housing 21 so that the device 10 can be carried by a handle 42 on the cover 38 (FIG.1) without extension of the tabletop 30 from the housing interior 22.

With reference now to FIGS. 2, 5, and 6, a seat 44 having a narrow lower elongated portion 45 and an upper enlarged portion 46 is mounted to each sidewall 14–20. Preferably, each sidewall 14–20 includes a like shaped hole 48 formed therethrough so that the seat 44 can be recessed in and flushed with its associated housing sidewall 14–20. Moreover, each seat 44 is substantially identical to the other seats 44 so that only the seat 44 pivotally connected with the sidewall 16 will be described in detail.

The lower or free end 50 of the seat portion 45 (when folded) is pivotally mounted to the sidewall 16 by means of a lateral rod 52 secured along its inner side. The lateral rod 52 protrudes laterally outwardly from the seat portion 45 and each end of the rod 52 is received within one of two spaced and parallel vertical rails 54 secured to the interior 22 of the housing 12 adjacent the hole 48. The rod 52 thus can slide from the bottom of the rails 54, when the seat 44 is in its folded position, to the top of the rails 54 when the seat 44 is in its outwardly extending or operable position, as shown in FIG. 6. A stop 55 disposed between the upper ends of the rails 54 and the sidewall 16 limits the upper travel of the rod 52 and its attached seat portion 45.

An elongated strut 56 is pivotally secured at 58 adjacent the enlarged portion 46 of the seat 44. The strut 56 is movable from a closed position, in which the strut 56 is in alignment and preferably flush with the seat portion 45, to an open position in which the strut 56 extends perpendicularly downwardly from the seat 44. With the seat 44 moved to its outwardly extending or horizontal position and with the strut 56 extending perpendicularly downwardly from the seat 44, the bottom end 60 of the strut 56 abuts against the ground 62 and supports the seat 44. The strut 56 also acts as a fulcrum point between the weight of a user sitting on the enlarged portion 46 of the seat 44 and the force of the rod 52 acting on the stop 55.

With reference to FIGS. 1 and 2, with the seats 44 in their vertical or closed position, the outer lip 39 of the cover 38 covers the upper edge of the enlarged portion 46 of each seat 44 to prevent the unintended extension of the seat 44 from the housing 12 while the device 10 is transported or stored.

In operation and assuming that the device 10 of the present invention is initially in its collapsed condition shown in FIG. 1, to extend the tabletop 30 and seats 44 from the housing 12, the upper cover 38 is first moved vertically upwardly from the housing 12. This in turn draws the carriage 26 with the attached and collapsed tabletop 30 upwardly and outwardly from the interior and through the top of the housing 12. When fully extended, the tabletop 30 is unfolded whereupon the housing 12 acts as a base support for the tabletop 30.

Thereafter, the seats 44 are unfolded and extended horizontally outwardly from the housing 12 while the struts 56 are unfolded and moved into an abutting engagement with the ground 62. While the device 10 is illustrated in the drawing with four foldable seats and with a round tabletop 30, it will be appreciated that both the number of seats 44 and also the shape of the tabletop 30 can vary as desired while remaining within the scope of the invention.

When collapse of the device 10 is desired, the lower end 50 of the seats 44 are moved downwardly in their cooperating rails 54 and each seat 44 is folded up and to its respective sidewall 14–20 while the struts 56 are folded into the seat 44. Thereafter, the tabletop 30 is folded into its cubical form illustrated in FIG. 5 and moved downwardly within the interior 22 of the housing 12 until the housing cover 38 covers the open ends of the housing 12 and overlaps the upper edge of each seat 44.

It will also be appreciated that the carriage 26 includes a notch 64 on each side (FIG. 5) which receives the rails 54 therethrough so that the carriage 26 can slide vertically along the rails 54. However, in the event that the seats 44 are not retracted into the housing 12 prior to retracting the tabletop 30 into the interior 22 of the housing 12, the carriage 26 will abut against the outwardly extending ends of the rods 52 and move the rods 52 with the attached seats 44 downwardly along the rails 54 as the carriage 26 is lowered into the housing interior.

With reference now to FIGS. 7 and 8, when the collapsible table and seat assembly 10 of the present invention is utilized for backyard or porch use, the assembly 10 can be advantageously stored within a like shaped recess 66 formed in the backyard or patio 68. By lowering the assembly 10 into the recess 66, the cover 38 is preferably substantially flush with the upper surface of the backyard or patio 68 and thus conveniently stored and out of the way. Conversely, the assembly 10 can be easily lifted outwardly from the recess 66 for use in the previously-described fashion. Any convenient means, such as a latch or by merely rotating the housing 12 45°, as shown in FIG. 8, can be used to secure the housing above the ground 68 when in use.

It can therefore be seen that the collapsible table and seat assembly according to the present invention provides a novel means whereby the tabletop is collapsibly received within the interior of the housing and, upon extension exteriorly of the housing, the housing supports the tabletop at an elevated horizontal plane. Moreover, the assembly 10 of the present invention is simple and inexpensive in construction and yet durable and efficient in operation. It will also be appreciated that assembly and disassembly of both the tabletop 30 and seats 44 is easily and rapidly accomplished.

Having described my invention any modifications thereto will become apparent to those skilled in the art to which it pertains without deviation from the spirit of the invention as defined by the scope of the appended claims.

I claim:

1. An apparatus comprising:

a housing having a hollow interior;

tabletop means foldable between an open and closed position, whereby in said closed position, said tabletop means is adapted to be contained within the interior of said housing and whereby in said open position said tabletop means is supported in an elevated and substantially horizontal position by said housing;

seat means secured to said housing and selectively extendable therefrom wherein said seat means comprises at least one seat pivotally secured at one end to said housing and movable between a retracted position and an extended position; and means for automatically locking each seat in its retracted position upon the insertion of said tabletop means within the interior of said housing.

2. The invention as defined in claim 1 wherein said housing includes a plurality of sidewalls and wherein each seat is received in a like-shaped aperture in one of said sidewalls when said seat is in its retracted position.

3. The invention as defined in claim 1 wherein the pivotally secured end of said seat is vertically slidably secured to said housing and slidable between a lower position when said seat is in its retracted position, and an upper position when said seat is in its extended position, and wherein said seat means further includes a strut pivotally secured to said seat at a position between the ends of said seat, said strut being movable to a substantially vertical ground engaging position for supporting said seat in a substantially horizontal position.

4. An apparatus comprising:

a housing having a hollow interior;

tabletop means foldable between an open and closed position, whereby in said closed position, said tabletop means is adapted to be contained within the interior of said housing and whereby in said open position said tabletop means is supported in an elevated and substantially horizontal position by said housing;

seat means secured to said housing and selectively extendable therefrom, wherein said seat means comprises at least one seat pivotally secured at one end to said housing and movable between a retracted position and an extended position; and wherein the pivotally secured end of said seat is vertically slidably secured to said housing and slidable between a lower position when said seat is in its retracted position, and an upper position when said seat is in its extended position, and wherein said seat means further includes a strut pivotally secured to said seat at a position between the ends of said seat, said strut being movable to a substantially vertically ground engaging position for supporting said seat in a substantially horizontal position.

5. The invention as defined in claim 4 wherein said housing includes a plurality of sidewalls and wherein each seat is received in a like-shaped aperture in one of said sidewalls when said seat is in its retracted position.

6. An apparatus comprising:

a housing having a hollow interior and open at its top;

tabletop means foldable between an open and closed position, whereby in said closed position, said tabletop means is slidably received through the open top of the housing and contained within the interior of said housing and whereby in said open position said tabletop means is supported in an elevated and substantially horizontal position by said housing, wherein said tabletop comprises a central section and a plurality of outer sections pivotally secured to said central section, said outer sections being movable from the open position in which said sections all lie in substantially the same plane, to the closed position in which said outer sections extend upwardly from said central section and in which the cross-sectional shape of said tabletop is smaller than the cross-sectional shape of the interior of said housing so that said tabletop can be slidably received through the open top of the housing and within the interior of said housing; and a vertically elongated rod secured at its lower end to the central section of said tabletop means and secured at its upper end to a lid which is adapted to cover the open top of said housing.

7. The invention as defined in claim 1 wherein said tabletop means comprises a central section and a plurality of outer sections pivotally secured to said central section, said outer sections being movable from the open position in which said sections all lie in substantially the same plane, to the closed position in which said outer sections extend upwardly from said central section and in which the cross-sectional shape of said tabletop means is smaller than the cross-sectional shape of the interior of said housing whereby said tabletop means can be slidably received within the interior of said housing.

8. The invention as defined in claim 1 and including means for storing said housing, said storing means comprising a recess having substantially the same shape as said housing formed in a ground support surface.

9. The invention as defined in claim 4 and including means for automatically locking each seat in its retracted position upon the insertion of said tabletop means within the interior of said housing.

* * * * *